United States Patent [19]

Nakabayashi et al.

[11] 4,356,982

[45] Nov. 2, 1982

[54] APPARATUS AND PROCESS FOR PRODUCING SLURRY

[75] Inventors: Yasuyuki Nakabayashi, Yokohama; Yoshiyuki Matsuno; Kihei Katsuta, both of Nagasaki, all of Japan

[73] Assignees: Electric Power Development Co. Ltd.; Mitsubishi Jukogyo Kabushiki Kaisha, both of Tokyo, Japan

[21] Appl. No.: 194,278

[22] Filed: Oct. 6, 1980

Related U.S. Application Data

[62] Division of Ser. No. 12,900, Feb. 16, 1979, Pat. No. 4,262,850.

[30] Foreign Application Priority Data

Feb. 23, 1978 [JP] Japan ..... 53-20559

[51] Int. Cl.[3] ..... B02C 23/36

[52] U.S. Cl. ..... 241/17; 241/21; 241/23; 241/46.17; 241/65

[58] Field of Search ..... 241/15, 16, 17, 21, 241/23, 29, 41, 42, 46 R, 46.02, 46.17, 65, 66, 67, 79.1, 24, 101 B, 26; 44/51; 366/149

[56] References Cited

U.S. PATENT DOCUMENTS

| | | | |
|---|---|---|---|
| 2,735,624 | 2/1956 | Beck | 241/26 X |
| 2,801,932 | 8/1957 | Witt | 241/21 |
| 2,830,769 | 4/1958 | Work | 241/65 X |
| 3,352,499 | 11/1967 | Campbell, Jr. | 241/21 |

*Primary Examiner*—Mark Rosenbaum

*Attorney, Agent, or Firm*—Wenderoth, Lind & Ponack

[57] ABSTRACT

A novel apparatus and process for producing slurry, the apparatus including a mill having an integral heating means, a solid feed means for feeding a lumpy solid into the mill, a liquid feed means for feeding a first liquid into the mill, and a liquid removal means for selectively removing a second liquid contained within the lumpy solid and having a boiling point different from that of the first liquid; the second liquid is evaporated by heating during the crushing of the lumpy solid when mixed with the first liquid within said mill, the mill having means for mixing and stirring the liquid/solid mixture to produce a slurry.

The process including steps for heating and crushing a first liquid/solid mixture and simultaneously removing a second liquid contained within the solid.

10 Claims, 2 Drawing Figures

APPARATUS AND PROCESS FOR PRODUCING SLURRY

This is a division of application Ser. No. 12,900, filed Feb. 16, 1979, now U.S. Pat. No. 4,262,850, which issued on Apr. 21, 1981.

BACKGROUND OF THE INVENTION

1. Field of the Invention

The present invention relates to an apparatus and process for producing slurry, and more particularly, to an apparatus and process for producing slurry that is adapted for the production of slurry consisting of coal fine powder and oil which is available as a fuel for boilers or the like.

As already known to those skilled in the art, coal in its natural state contains water.

2. Description of the Prior Art

In a heretofore known apparatus for producing a coal/oil slurry, as shown in FIG. 1, lumpy coal stored in a coal bin 1 is fed to a mill 3 via a metering feeder 2, and within the mill 3 it is crushed and simultaneously dried under existence of a hot blast fed from a hot air feeder 4. The dried fine powder coal enters into a cyclone 5 as carried by the hot blast and is separated from the hot blast in the cyclone, while unseparated fine powder coal further enters into a bag filter 6 where it is collected. The dried fine powder coal separated in the cyclone 5 or collected by the bag filter 6 enters into a fine powder coal bunker 8 to be accumulated, and then is fed to a slurry mixing tank 12 by means of a fine powder coal feeder 9. Oil is fed to mixing tank 12 from an oil storage tank 10 by means of an oil feed pump 11, and the fine powder coal and the oil are stirred into slurry in the mixing tank 12 by means of a stirrer 13. The slurry is then transported to a slurry storage tank 15 by means of a slurry transport pump 14. In addition, reference numeral 7 designates a suction blower for aiding in the transfer of the fine powder coal.

The above-described apparatus in the prior art has a disadvantage that not only are the cyclone 5 or the bag filter 6 for separating or collecting fine powder coal great in size, resulting in increase in the cost of equipment and the area for their installation, but also a bridging phenomena may arise in the fine powder coal bunker 8, and dispersion of fine powder coal into the atmosphere is liable to occur. Therefore, handling of the fine powder coal, including separation, collection, transportation and storage is difficult.

SUMMARY OF THE INVENTION

Therefore, it is one object of the present invention to provide a novel apparatus and process for producing slurry which is free from the disadvantages of the apparatus in the prior art.

According to one feature of the present invention, an apparatus and process are provided for producing slurry, the apparatus comprising a mill having an integral heating means, a solid feed means for feeding a lumpy solid into said mill, a liquid feed means for feeding a first liquid into said mill, and a liquid removal means for selectively removing a second liquid contained within the lumpy solid and having a boiling point different from that of said first liquid; the second liquid evaporated by heating during the crushing of said lumpy solid when mixed with said first liquid within said mill, the mill having means for mixing and stirring the liquid/solid mixture to produce a slurry. The process includes steps for heating and crushing a first liquid/solid mixture, and simultaneously removing a second liquid contained within the solid.

BRIEF DESCRIPTION OF THE DRAWINGS

The above-mentioned and other features and objects of the present invention will become more apparent by reference to the following description of its preferred embodiment taken in conjunction with the accompanying drawings, in which.

DESCRIPTION OF THE PREFERRED EMBODIMENT

Figure 1:
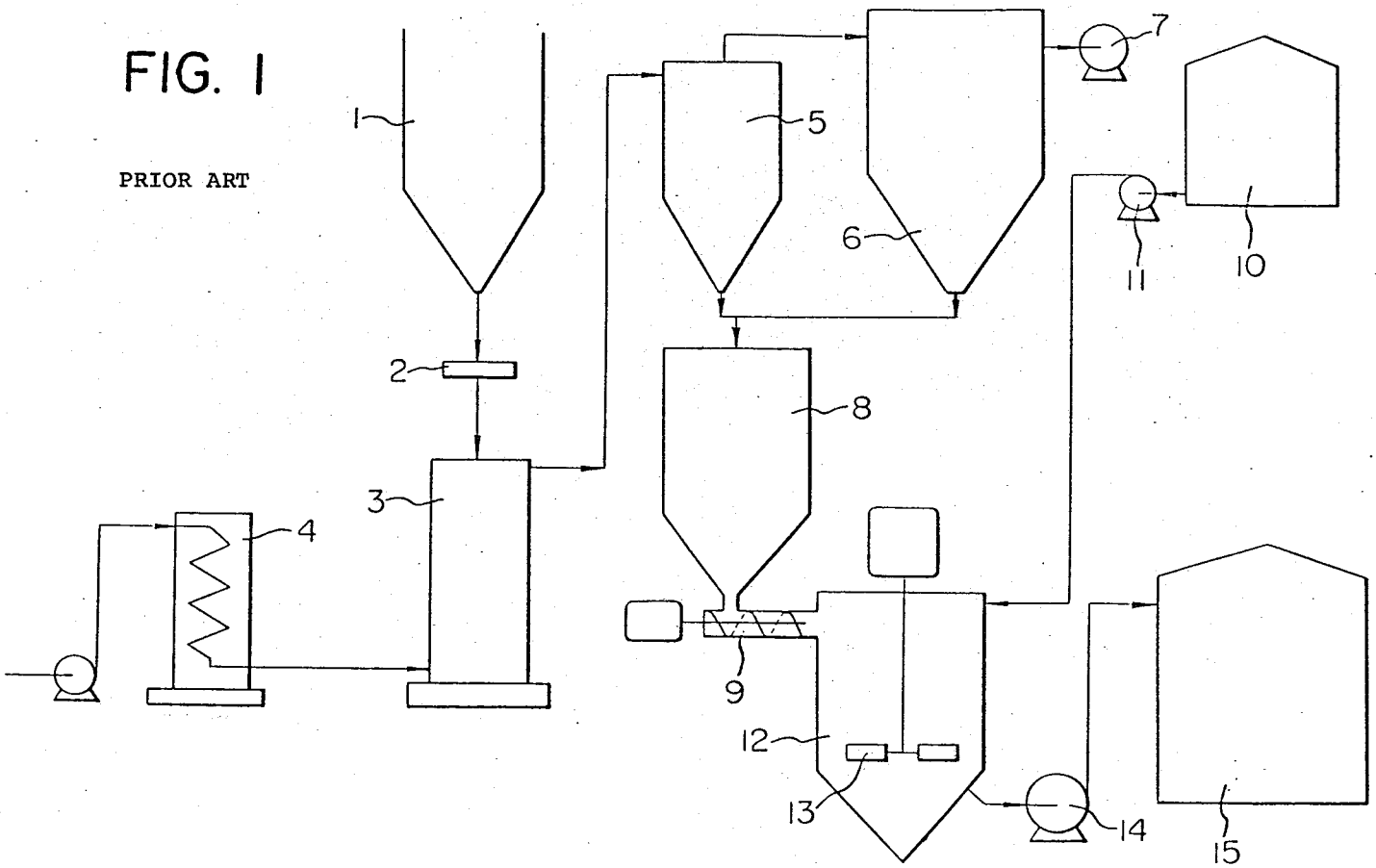
FIG. 1 PRIOR ART
FIG. 1 is a schematic system diagram showing an apparatus for producing slurry in the prior art.
Figure 2:
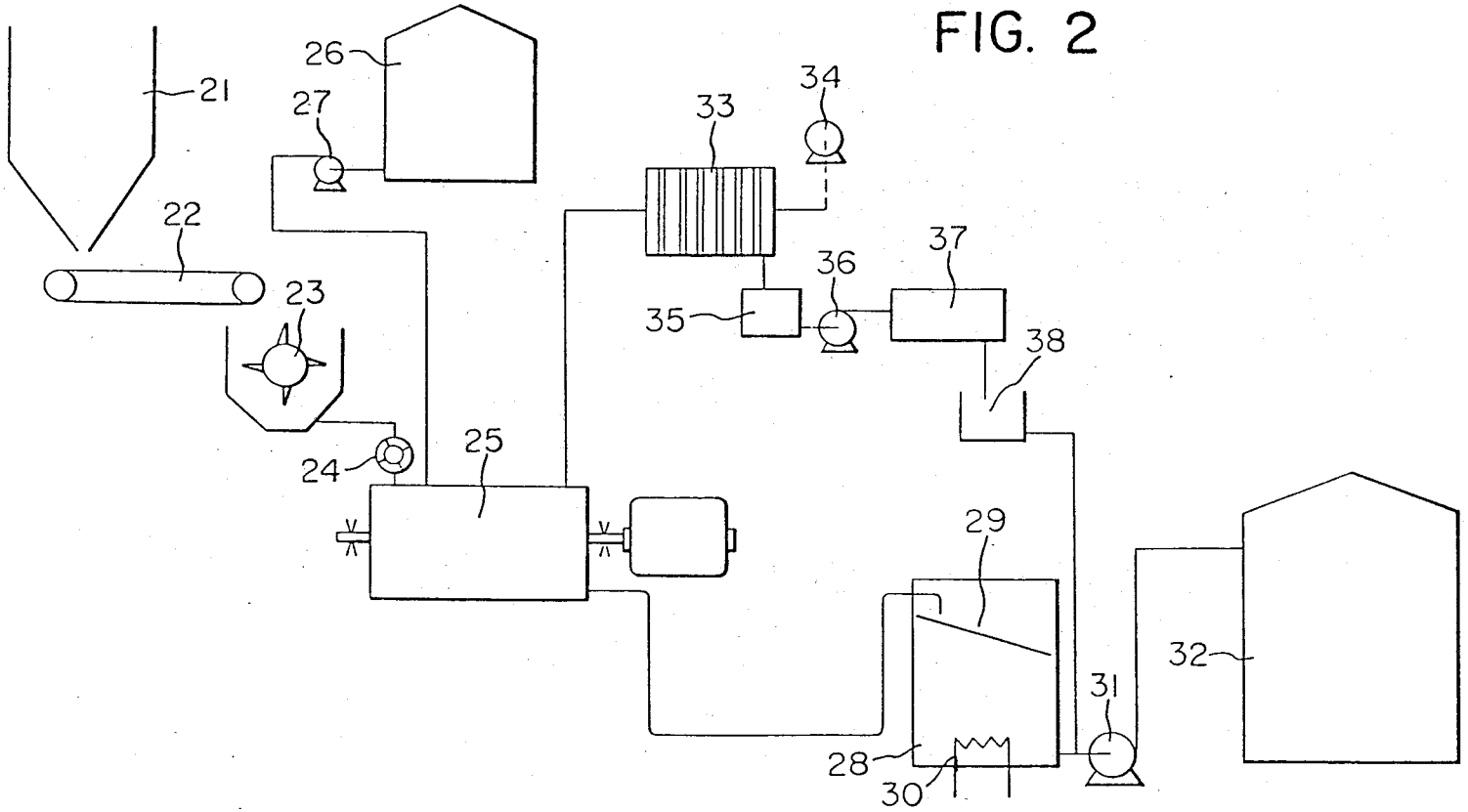
FIG. 2 is a schematic system diagram showing one preferred embodiment of the present invention.

Referring now to FIG. 2 of the drawings, reference numeral 21 designates a coal bin, numeral 22 designates a belt feeder, numeral 23 designates an impact crusher, numeral 24 designates a feeder, and numeral 25 designates a mill having an integral heater (not shown) for heating the interior of the mill. Reference numeral 26 designates an oil storage tank, numeral 27 designates an oil feed pump, numeral 28 designates a slurry tank, numeral 29 designates a vibrating screen, numeral 30 designates a heat exchanger, numeral 31 designates a slurry transport pump, numeral 32 designates a slurry storage tank, numeral 33 designates a condenser, numeral 34 designates a suction blower, numeral 35 designates an oily water tank, numeral 36 designates an oily water transport pump, numeral 37 designates an oil-water separator, and numeral 38 designates an oil receptacle tank.

In operation, lumpy coal stored in the coal bin 21 is fed to the impact crusher 23 by means of the belt feeder 22. After the coal has been coarsely crushed in the impact crusher 23, it is fed to the mill 25 by means of the feeder 24. On the other hand, oil having a boiling point higher than that of water such as, for example, crude oil, C-heavy oil or the like is also fed to the mill 25 by means of the oil feed pump 27. Within the mill 25, coal is crushed in the presence of oil and simultaneously heated up to a temperature higher than the evaporation temperature of water by means of the associated integral heater. The coal is stirred and mixed with oil. The thus produced vapor of oily water partly containing vapor of an oil content is transferred to the condenser 33 by means of the suction blower 34. After it has been cooled and liquified in the condenser 33, the oily water is transferred to the oily water tank 35, and then is transported to the oil-water separator 37 by means of the oily water transport pump 36.

In this separator 37, oil is separated from water and is stored in the oil receptacle tank 38. On the other hand, the slurry obtained within the mill 25 by being crushed in the presense of oil and by being stirred and mixed with the oil, is fed to the slurry tank 28, wherein coarse particles of coal that are not fully crushed are removed by means of the vibrating screen 29. Since the slurry fed to the slurry tank 28 is at a high temperature, when it is necessary to cool the hot slurry, a heat exchange can be effected between the slurry and the oil fed from the oil storage tank 26 to the mill 25 so that the cooling of the slurry as well as the heating of the oil may be achieved. The slurry delivered from the slurry tank 28 is mixed at the outlet of the tank 28 with the oil fed from the oil receptacle tank 38 to recover the evaporated oil that is lost in the mill 25, and then the slurry is transported to the slurry storage tank 32 by means of the slurry transport pump 31 and is stored therein.

As fully described above in connection with one preferred embodiment, in the apparatus according to the present invention, since coal is crushed in the presence of oil in a heated state within the mill and is stirred and mixed with the oil, a dried fine powder coal as in the case of the prior art apparatus would not be produced. Accordingly, neither equipment for separation or collection of dried fine powder coal such as a cyclone, a bag filter or the like, nor a fine powder coal storage tank for storing the same is necessary, and the dried fine powder coal is not dispersed into the atmosphere. Since the cyclone and the bag filter are not necessary, the equipment becomes small in size, resulting in a reduction in its cost and an area for installation, and at the same time, since a fine powder coal storage tank is not provided, the disadvantage of the prior art bridging phenomena does not arise. Furthermore, the present invention does not require the process of crushing and drying lumpy coal within a mill, separating the crushed coal from air and collecting the same by means of a cyclone, a bag filter or the like, and further stirring and mixing the same with oil in a slurry mixing tank as is the case of the apparatus in the prior art, but in the apparatus according to the present invention, crushing of lumpy coal, stirring and mixing with oil having a higher boiling point than water, and evaporation and removal of water content by heating are achieved simultaneously within a mill, so that the process can be extremely simplified, and consequently, the equipment is also simplified and at the same time the cost of the equipment is reduced.

While the invention has been described above in connection to the case where slurry consisting of fine powder coal and oil is produced, it is a matter of course that the present invention is equally applicable to production of slurry consisting of solid material other than coal and liquid material other than oil.

What is claimed is:

1. An apparatus for producing slurry comprising:

a mill;

a storage tank;

a liquid feed means for feeding a first liquid from said storage tank into said mill;

a solid feed means separate from said liquid feed means for feeding a lumpy solid into said mill, said lumpy solid containing a second liquid therein;

said mill having a crushing, mixing and stirring means for crushing said lumpy solid in the presence of said first liquid and mixing said crushing lumpy solid and said first liquid to produce a slurry;

said mill having a heating means for heating said slurry and said lumpy solid and said second liquid to a predetermined temperature such that said second liquid is substantially evaporated while said first liquid is substantially unaffected;

said apparatus further comprising a removal means for removing said evaporated second liquid and a heat-exchanger means for effecting the exchange of heat from said heated slurry to said first liquid in said storage tank, whereby thermal energy is economized.

2. An apparatus as in claim 1, further comprising means for selectively removing particles of said lumpy solid within said slurry having a size greater than a predetermined value.

3. An apparatus as in claims 1 or 2, wherein said first liquid comprises an oil.

4. An apparatus as in claims 1 or 2, wherein said lumpy solid comprises coal.

5. An apparatus as in claims 1 or 2, wherein said second liquid comprises water.

6. A process for producing slurry comprising the steps of:

providing a mill;

feeding a first liquid into the mill;

feeding a lumpy solid into the mill separately from the feeding of the first liquid, the lumpy solid containing a second liquid therein;

crushing, mixing and stirring the lumpy solid in the presence of the first liquid to produce a slurry;

heating the slurry and the lumpy solid and the second liquid to a predetermined temperature such that the second liquid is substantially evaporated while the first liquid is substantially unaffected;

removing the evaporated second liquid and extracting heat from the slurry and using the extracted heat to heat the first liquid.

7. A process as in claim 6, further comprising the step of selectively removing particles of the crushed lumpy solid having a size greater than a predetermined value.

8. The process as in claims 6 or 7, wherein the first liquid comprises oil.

9. The process as in claims 6 or 7, wherein the fed lumpy solid comprises coal.

10. The process as in claims 6 or 7, wherein the second liquid comprises water.

* * * * *